US010286568B2

(12) United States Patent
Pras et al.

(10) Patent No.: US 10,286,568 B2
(45) Date of Patent: May 14, 2019

(54) CUTTING UNIT

(71) Applicant: SANDVIK INTELLECTUAL PROPERTY AB, Sandviken (SE)

(72) Inventors: Arnaud Pras, Jarcieu (FR); Mergola Luigi, Romans (FR)

(73) Assignee: HYPERION MATERIALS & TECHNOLOGIES (SWEDEN) AB, Stockholm (SE)

( * ) Notice: Subject to any disclaimer, the term of this patent is extended or adjusted under 35 U.S.C. 154(b) by 0 days.

(21) Appl. No.: 13/870,090

(22) Filed: Apr. 25, 2013

(65) Prior Publication Data

US 2013/0283987 A1 Oct. 31, 2013

(30) Foreign Application Priority Data

Apr. 27, 2012 (EP) ..... 12165937

(51) Int. Cl.

| | |
|---|---|
| ***B26D 1/40*** | (2006.01) |
| ***B26D 7/26*** | (2006.01) |
| ***B26D 7/22*** | (2006.01) |
| ***B26F 1/38*** | (2006.01) |

(52) U.S. Cl.

CPC ..... *B26D 1/405* (2013.01); *B26D 7/22* (2013.01); *B26D 7/265* (2013.01); *B26F 1/384* (2013.01); *Y10T 83/4833* (2015.04)

(58) Field of Classification Search

CPC ..... B26D 7/26; B26D 7/204; B26D 7/265; B26D 1/62; B26D 2007/2607; B26D 2007/2657; B26D 2007/2664; B26D 1/405; B26D 7/22; B26F 1/384; Y10T 83/483–83/4844

USPC ..... 83/343–348

See application file for complete search history.

(56) References Cited

U.S. PATENT DOCUMENTS

| | | | | |
|---|---|---|---|---|
| 5,156,076 A * | 10/1992 | Rosemann | B26D 7/2628 | 100/168 |
| 5,174,185 A | 12/1992 | Aichele | | |
| 5,388,490 A * | 2/1995 | Buck | B26D 7/2628 | 83/344 |
| 5,404,780 A * | 4/1995 | Berne | B26D 1/245 | 83/345 |
| 7,299,729 B2 * | 11/2007 | Cox | B23D 35/008 | 83/343 |

(Continued)

FOREIGN PATENT DOCUMENTS

| | | |
|---|---|---|
| DE | 3924053 A1 | 1/1991 |
| EP | 1710058 A1 | 10/2006 |

*Primary Examiner* — Evan H MacFarlane

(57) ABSTRACT

A cutting unit includes a stationary frame, a cutting drum, and an anvil drum. The cutting drum and the anvil drum are arranged one over the other for cutting web material fed therebetween. The upper drum is centerd on a rotatable arbour and rotatably supported in the stationary frame. The lower drum is rotatable and movable towards and away from the upper drum. A rotatable carrier, movable towards and away from the upper drum, includes at least two contact rollers. The lower drum is shaftless and rests on the contact rollers. At least one contact roller is situated on either side of a central vertical plane of the lower drum for providing support of the lower drum by the contact rollers only. A pressing device moves the carrier and the lower drum towards and against the upper drum for providing cutting pressure between the upper drum and the lower drum.

18 Claims, 9 Drawing Sheets

(56) References Cited

U.S. PATENT DOCUMENTS

2006/0243111 A1* 11/2006 Grenier ..... B26D 7/2628
83/343
2012/0234145 A1* 9/2012 Kandemir ..... B26D 7/204
83/56

* cited by examiner

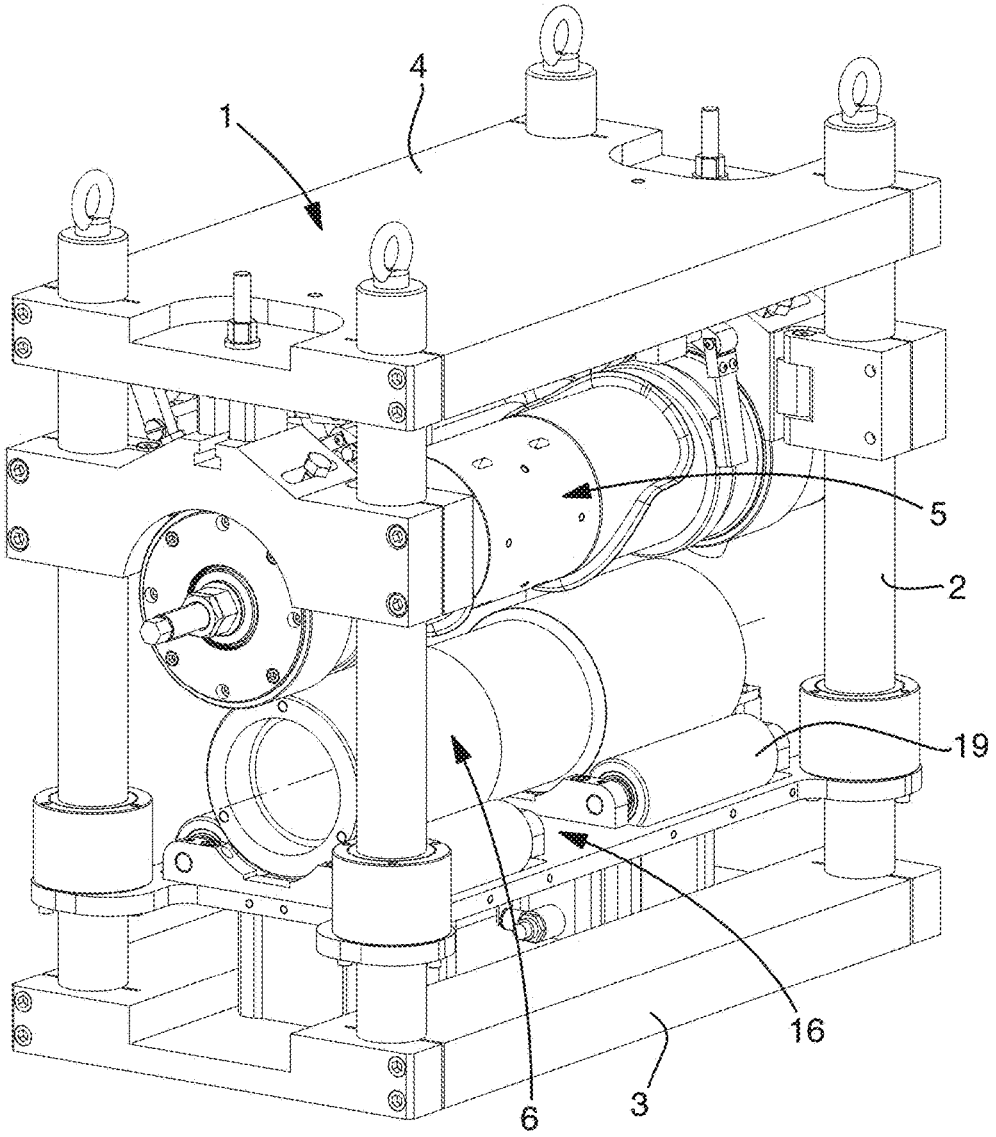
*Fig 9*
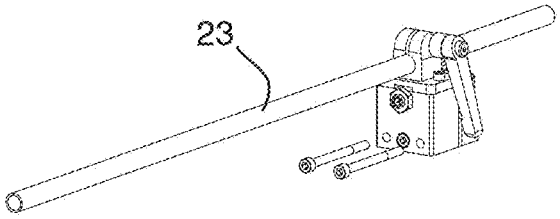

CUTTING UNIT

TECHNICAL FIELD

The present invention relates to a cutting unit comprising a cutting drum and an anvil drum arranged one over the other for cutting web materials fed between them.

BACKGROUND

Prior art cutting units often comprise a cutting drum and an anvil drum. These are arranged on arbours, which are rotatable supported in a frame by bearing blocks. The cutting drum and the anvil drum are arranged one over the other with their arbours and axis of rotation extending horizontal and in parallel. In the prior art cutting units are known, where the cutting drum is arranged over the anvil drum, and cutting units, where the anvil drum is arranged over the cutting drum. Normally at least one of the drums is connected to a driving device for rotating the arbour with the drum.

Cutting units are normally used for continuously cutting web material fed between the upper and the lower drum. The cut articles and the trim are evacuated by for example conveyors and vacuum nozzles.

A known type of cutting unit has hydraulic, extendable cylinders that bear between the frame and the lower drum to press it against the upper drum for affecting the desired cutting pressure. To this end, the bearing blocks of the lower drum are movable arranged on linear guides, while the bearing blocks of the upper drum are fixed in the frame.

After the cutting unit has been run a certain time, the cutting drum and the anvil drum have to be reground. A problem with regrinding is that in order to obtain desired cutting depth and cutting force during use, the cutting portions and anvil portions of the drums have to be strictly concentric in combination with an exact centring of the drum on the arbour and in the bearing blocks, which requires a very exact regrinding operation. In addition, the drums have to be removed from the cutting unit in order to carry out regrinding. This is a rather complex and time consuming operation, especially for the lower drum, which is more difficult to access below upper drum.

SUMMARY

It is therefore an object of the present invention to provide a cutting unit, which alleviates at least one of the above-mentioned problems.

A cutting unit according to the invention comprises a stationary frame, a cutting drum having a cutting knife on an outer cylindrical surface thereof and a centre axis, and an anvil drum having an outer cylindrical surface and a centre axis. The cutting drum and the anvil drum are arranged one over the other with parallel centre axes for cutting web material fed between them. The upper of the cutting drum and the anvil drum is centred on an arbour, which is rotatable supported in the stationary frame and connectable to a driving device for rotating the arbour and the upper drum around the centre axis thereof. The lower of the cutting drum and the anvil drum is arranged rotatable around the centre axis thereof, and is arranged movable towards and away from the upper drum. The cutting unit further comprises a carrier, which is arranged movable towards and away from the upper drum. The carrier comprises at least two contact rollers, which have an outer cylindrical surface and which are arranged rotatable round a respective axis in the carrier, which axes are parallel to the centre axis of the cutting drum and the anvil drum. The lower drum is shaftless and is arranged with the outer cylindrical surface thereof resting on the outer cylindrical surface of the at least two contact rollers, wherein at least one contact roller is situated on either side of a central vertical plane of the lower drum for providing vertical and transversal support of the lower drum by the contact rollers only. The carrier is connectable to a pressing device for moving and pressing the carrier and the lower drum carried thereby towards and against the upper drum for providing cutting pressure between the upper drum and the lower drum.

Due to the provision of a carrier comprising contact rollers, the arbour/shaft for the lower drum can be refrained from, as well as corresponding bearing blocks in the frame. Thus, the lower drum is shaftless and supported vertically and transversally in the cutting unit by the carrier only. Since the carrier is movable arranged and connectable to a pressing device, the lower drum can be pressed against the upper drum in order to achieve a desired cutting pressure. The outer surface of the carrier rolls can be carefully manufactured to exact concentricity and they can during initial mounting be carefully positioned in the carrier. Then, the position of the lower drum in the carrier is well defined. During regrinding of the lower drum, the operator still has to ensure good cylindrical form of the lower drum. However, unlike when regrinding lower drums of prior art cutting units, the operator needs not observe good concentricity with respect to the centre axis, nor observing the position of the centre axis with respect to the arbour or the bearing blocks. The cylindrical form of the lower drum is during regrinding directly realized by rotating the lower drum with the outer peripheral surface thereof in contact with the grindstone. Consequently, the lower drum and support thereof by the carrier arrangement according to the present invention enable easier regrinding of the lower drum while the lower drum has the same movable function as prior art movable, lower drums.

During use, the cutting unit is intended to rest on a horizontal plane. In this application expressions as "lower", "upper", "vertical" and "horizontal" relate to this horizontal plane.

The drums of the cutting unit according to the present invention have a longitudinal extension round a centre axis. The expression "transverse" refers to a horizontal direction that is perpendicular to the longitudinal axis/centre axis. A "transverse plane" is to be understood as a vertical plane that is normal to the centre axis.

The cutting unit according to the present invention is intended to continuously cut articles from a web material. Examples for articles that can be produced in this way are paper or card board blanks for packages, labels and hygienic products, such as diapers and sanitary towels. The web material can comprise a single layer or several layers, which can be laminated or held together in any other suitable way. When producing hygienic products, the web material can comprise layers of woven material, non-woven material, absorbent material and backing material.

According to the invention, the cutting unit comprises a stationary frame. The frame is stationary with respect to movable parts of the cutting unit, but can be movable together with the cutting unit as a whole. The frame can comprise bars and plates forming a skeleton for supporting and holding together the parts of the cutting unit.

The cutting unit according to the invention comprises a cutting drum and an anvil drum. The drums have a longitudinal extension round a longitudinal centre axis of revolution. The drums have an overall general cylindrical shape. The peripheral outer surface of the drums is rotational symmetrical round the centre axis of revolutions and has a constant diameter in zones that are active in cutting. The drums may also include zones that are inactive during cutting, which may have a smaller diameter or have non-circular cross sections.

The cutting drum has a cutting knife on an outer cylindrical surface thereof. The cutting knife forms a cutting ridge on the surface, which forms a curve in the circumferential and/or axial directions of the cutting drum. The curve formed by the extension of the cutting knife over the cutting drum corresponds to the contour of the articles to be cut.

The anvil drum and the cutting drum can comprise steel or be made from a harder material such as cemented carbide or the like. The drums can have an outer tube of the harder material applied to an inner tube or core of steel, for example by shrink fitting.

According to the invention, the cutting drum and the anvil drum are mounted one over the other. Normally, their axes of revolutions are parallel and located in a common vertical plane. One of the cutting drum and the anvil drum is the upper drum and the other is the lower drum.

The upper drum is centred on an arbour. The arbour may be in one piece extending through the upper drum from one axial end to the other or comprise a part of limited length at each end. The arbour has ends extending axially from the upper drum at each axial end. These ends are rotatable supported in the stationary frame, for example by bearing blocks. The arbour is at one end connectable to a driving device which is operable to rotate the arbour and the upper drum mounted thereon round the centre axis of revolution.

The cutting unit according to the invention comprises a carrier, which supports at least two contact rollers. The carrier can comprise a framework of bars or a plate. The contact rollers are rotatable supported in the carrier. The axes of revolution of the contact rollers are parallel to the centre axis of revolution of the lower drum.

The lower drum rests with its outer peripheral surface on the outer peripheral surface of the contact rollers. The contact rollers are arranged below a central horizontal plane of the lower drum for such receiving the lower drum and providing vertical support. The contact rollers may, but needs not, have the same and constant diameter. It is sufficient if the outer peripheral surface of the contact rollers is tangent with the outer surface of the lower drum at least over a portion. One contact roller is arranged on either side of a vertical plane through the lower drum for providing support in both transverse directions of the lower drum.

The lower drum is shaftless, i.e. it has no arbour for supporting it in the frame. The lower drum is sufficiently supported for rotation, and in both transversal directions and in the vertical direction by the carrier only. Thus, the support provided by the carrier is sufficient for ensuring adequate operation during cutting. Additional support is however not excluded.

The carrier is connectable to a pressing device for pressing the lower drum against the upper drum for providing cutting pressure. The pressing device can be a mechanical device such as a screw, or hydraulic or pneumatic cylinders. The cutting pressure can be constant, set to a selectable value or continuously adjustable.

The contact rollers can have the same or different longitudinal length. The carrier can comprises only two contact roller or many contact rollers on both sides of the vertical plane comprising the centre axis of the lower drum. The contact rollers can have an axial length or be disc-shaped. The contact rollers can be arranged on common axes of rotation (one at each side of the vertical plane). An advantage of having long or several contact rollers distributed over the length of the lower drum on each side of the vertical plane, is that the lower drum is prevented from twisting. Another advantage is that the lower drum is supported over its length and that the pressing force from the carrier is distributed over the length of the lower drum so that the lower drum is less prone to bending. Thereby, the cutting depth and/or force will be more even along the axial length of the drums.

According to one embodiment of the cutting unit according to the invention, the contact rollers are arranged in the carrier in pairs. Two contact rollers are located opposite each other on either side of a vertical plane through the longitudinal centre axis of the lower drum. An advantage herewith is that the load of the lower drum is distributed evenly, which provides a more stable support. However, in other embodiments, the contact rollers can be arranged non-symmetrical. For example, the contact rollers can be located with their centre axis at different heights with respect to a central horizontal plane through the power drum, the contact roller can be arranged displaced relative each other in the longitudinal direction of the lower drum as seen on either side of a vertical plane through the longitudinal centre axis of the lower drum.

According to one embodiment of the cutting unit, the cutting knife forms a curve in the circumferential and/or axial directions of the cutting drum in a cutting zone of the cutting drum. In an embodiment according to the invention comprising a pair of contact rollers, the contact rollers have a longitudinal length corresponding to the longitudinal length of the cutting zone and are arranged below the cutting zone. Consequently, the pressure transmitted by the contact rollers when the carrier moves the lower drum towards the upper drum extends over the area where the cutting is performed. An advantage with this arrangement is that the drums are subjected to less bending so that the cutting depth will be more equal along the axial, longitudinal direction. This is true for embodiments where the cutting drum is the lower drum as well as for embodiments where the anvil drum is the lower drum.

According to one embodiment of the cutting unit according to the invention, the cutting drum comprises a bearer ring at each axial end thereof for being in rolling contact with the anvil during cutting. In an embodiment according to the invention comprising a pair of contact rollers, the contact rollers are arranged below the bearer rings. Consequently, the pressure transmitted by the contact rollers when the carrier moves the lower drum towards the upper drum is exerted at the area of the bearer rings. An advantage with this arrangement is that no bending is induced by the pressure from the carrier with the carrier rolls, because the pressure is applied to the lower drum at the same area as the counter pressure is applied by the upper drum bearer rings bearing against the lower drum. Thus, the cutting pressure and/or depth will advantageously be more equal along the axial length of the drums. This is true for embodiments where the cutting drum is the lower drum as well as for embodiments where the anvil drum is the lower drum.

According to one embodiment of the present invention, the cutting unit comprises axial bearings for supporting the lower drum in the directions of the centre axis. The axial bearings can be of any suitable kind, for example a stop lug with a low friction surface for sliding against the rotating lower drum, a ball bearing, a roller bearing, a single wheel. The axial bearing can be mounted on the stationary frame.

An advantage with axial bearings is that the lower drum is secured more reliable in the axial direction.

According to one embodiment of the present invention, the lower drum is hollow, or in other words, the lower drum has the shape of a hollow tube. An advantage herewith is that the lower drum is lighter than a solid lower drum. Thereby the lower drum requires less energy to rotate and to move up and down, and is easier to mount and dismount, and the whole cutting unit will weigh less.

According to one embodiment of the present invention, the cutting unit comprises a safety device for preventing the lower drum from leaving the resting position thereof on the contact rollers. Since the lower drum lacks an arbour, it is freely supported on the carrier and is not locked to the frame by bearing blocks as are prior art drums. Thus, due to for example malfunction during cutting operations, the lower drum could possibly lift from the contact roller and damage other parts of the cutting unit. The safety device is intended to engage with the lower drum and restrain it to the contact rollers or at least force it back on to them, in case the lower drum should be subjected to forces striving to push the lower drum away from its resting position. The safety device can be of any suitable kind, for example a bar extending through a hollow lower drum, or plates extending to the sides of the lower drum.

According to one embodiment of the present invention, the stationary frame comprises an opening facing the axial end of the lower drum. Preferably, the opening is located in line with the lower drum when the lower drum is in a lower position, distanced from the upper drum. However, in other embodiments, the opening can be in line with the lower drum when it is in other, raised positions. This opening is larger than the largest cross section of the lower drum. Due to the lower drum resting freely on the carrier and not being attached to the frame by bearings, the lower drum can be easily removed from the cutting unit through this opening. In embodiments having safety devices and axial support devices for the lower drum, these may have to be removed first. However, removal of the lower drum is still considerably easier according to this embodiment than in many prior art cutting units, because in many prior art cutting units first upper parts of the frame have to removed, then the upper drum with its shaft and bearings and finally the lower drum with its shaft and bearings.

According to one embodiment of the present invention, the lower drum is the anvil drum. This construction is advantageous with respect to handling of the web and cut articles during operation. To have the anvil drum below is especially advantageous in embodiments where the lower drum is axially removable. One frequent reason for removing a drum is for regrinding. Normally the anvil drum wears faster than the cutting drum. If the cutting drum is made of cemented carbide, the anvil drum is reground about three times as often as the cutting drum.

According to one embodiment of the present invention, the cutting unit comprises a linear guide for guiding the carrier during pressing thereof towards and against the upper drum. An advantage with the linear guide is that the axis of rotation of the upper drum and the lower drum are held more in parallel, which enables better cutting quality. The linear guide can constitute a part of the frame.

BRIEF DESCRIPTION OF THE DRAWINGS

The invention may be performed in many different ways, and by way of example only, embodiments thereof will be described in detail with reference being made to accompanying drawings, in which:

FIG. 8-10 show how the lower drum can be removed in the first embodiment of the invention;

DETAILED DESCRIPTION

Figure 1:
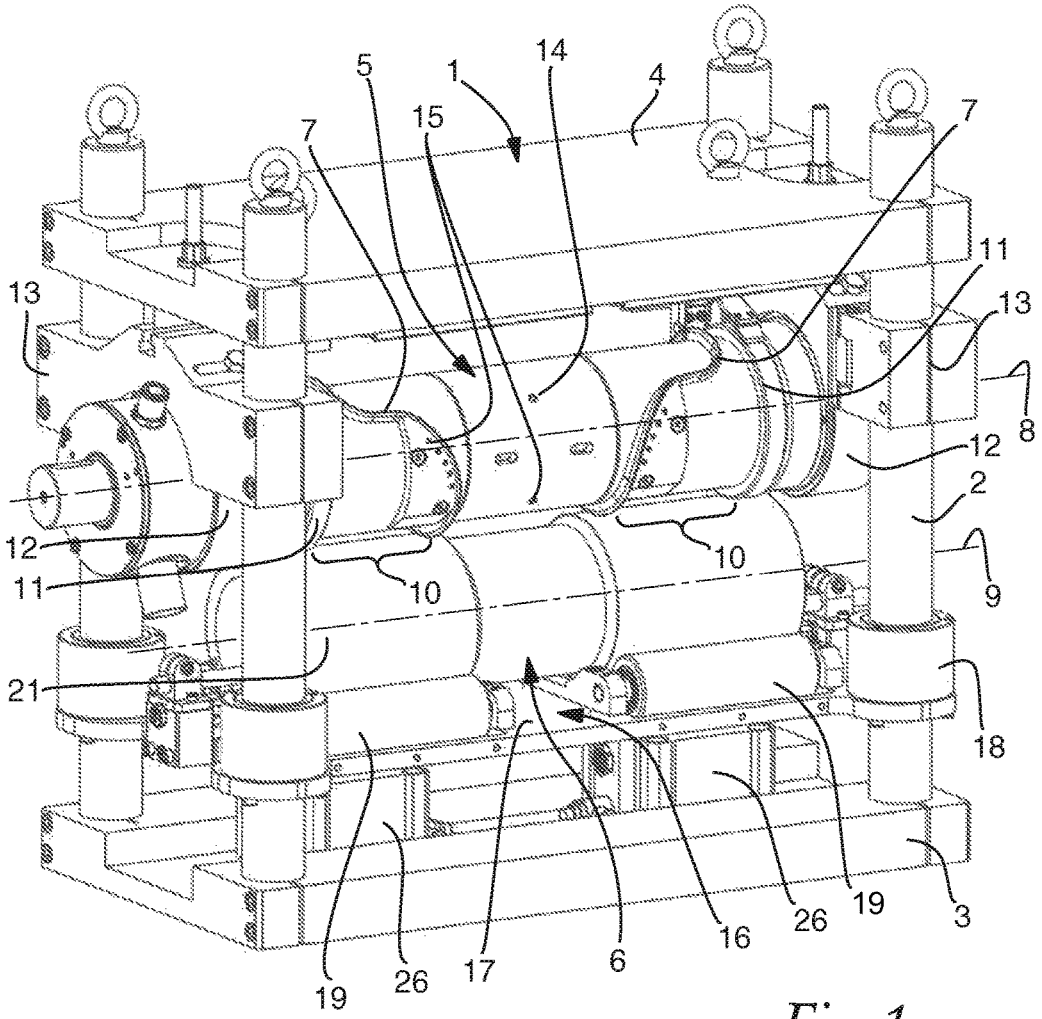
FIG. 1 is a front perspective view of a cutting unit according to a first embodiment of the invention.
Figure 2:
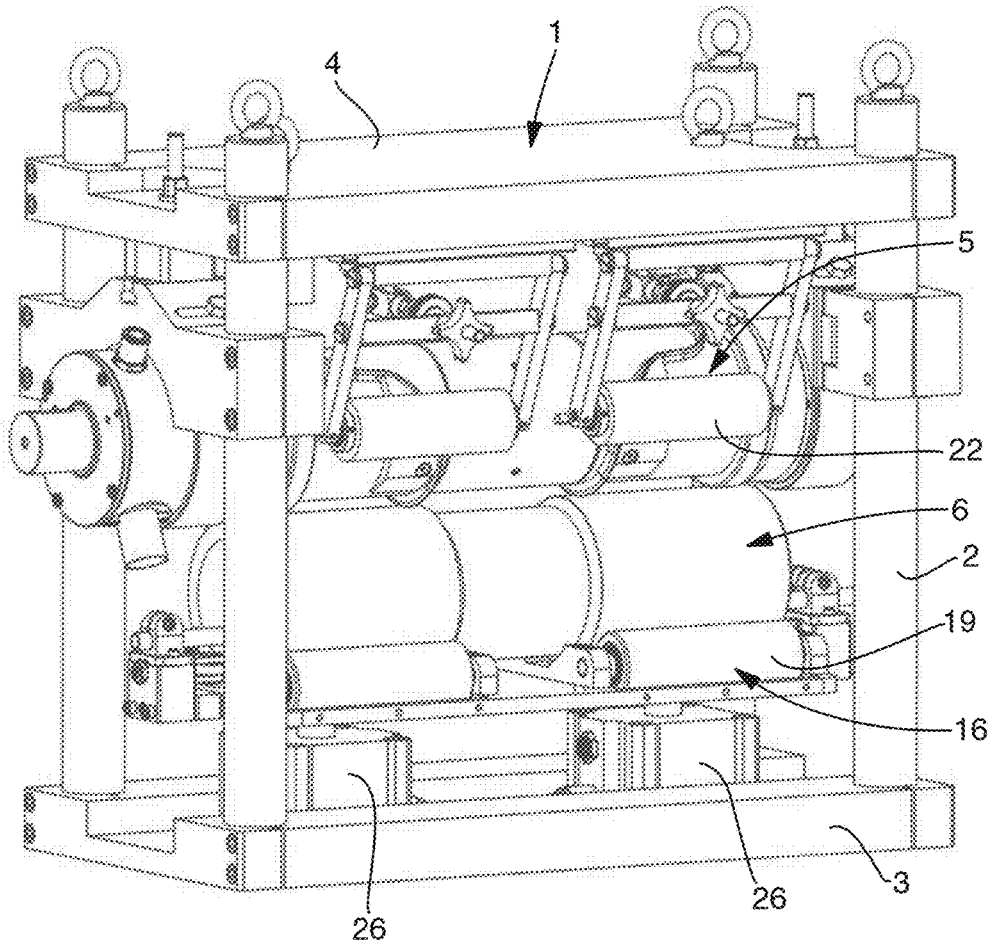
FIG. 2 is a rear perspective view of a cutting unit according to the first embodiment of the invention, wherein the bearings of the carrier has been removed.
Figure 3:
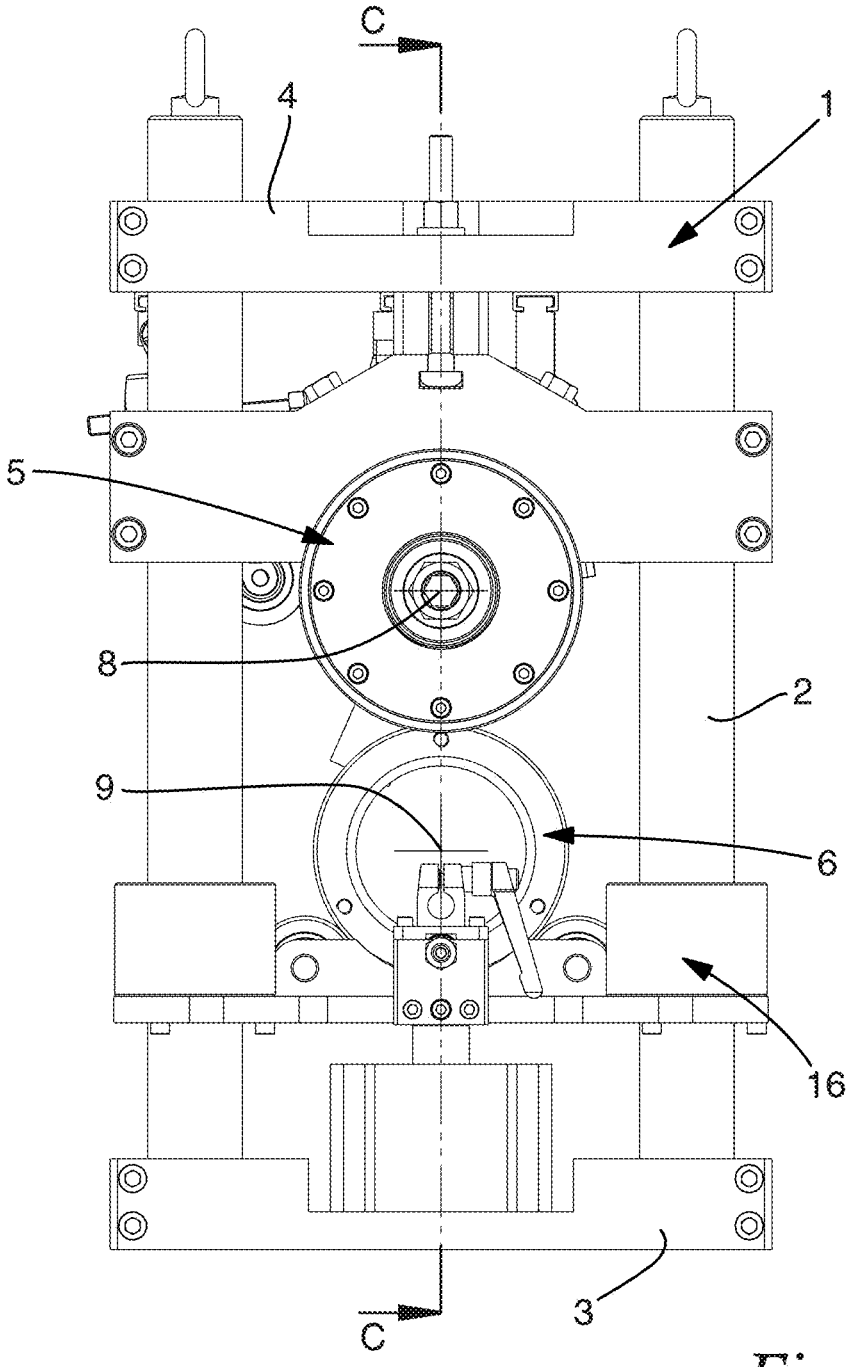
FIG. 3 is a side view of a cutting unit according to the first embodiment of the invention.

With reference to FIGS. 1-6, a first embodiment of the cutting unit according to the present invention is shown. The cutting unit comprises a stationary frame 1, which includes four corner columns in the form of tubes with circular cross section 2, a base plate 3 and a top plate 4. During use, the base plate 3 is intended to be supported horizontally such that the base plate 3 has its extension in a horizontal plane. The cutting unit further comprises an upper drum 5 in the form of a cutting drum and a lower drum 6 in the form of an anvil drum, wherein "upper" and "lower" is relative the horizontal plane of the base plate 3. The drums 5, 6 have an overall cylindrical shape and longitudinal centre axis of rotation, 8, 9. The axes of rotation 8, 9 of the cutting and anvil drums 5, 6 are parallel and located in the same vertical plane C, c.f. FIG. 3.

The cutting drum comprises two cutting knives 7, which form an axially and circumferentially curving ridge over a mantle surface of the cutting drum 5. There is arranged a curving cutting knife 7 at each axial end of the cutting drum 5 in a cutting zone 10, c.f. FIG. 1. Between the cutting zones 10, there is a central zone 14 that is not involved in the actual cutting. The cutting drum 5 comprises a bearer ring 11 at each axial end.

An arbour comprises two parts extending from the cutting drum, one at each axial end. The arbour parts are received in a bearing block 12, respectively. The bearing blocks 12 are attached to the vertical columns 2 of the frame by means of a yoke 13, respectively. The bearing block 12 allow the arbour with the cutting drum 5 to rotate round the centre axis 8 relative the stationary frame 1. To this end, one of the arbour parts can be connected to a driving device for rotating the cutting drum 5. The driving device can include an electric motor, gearing components and transmission components (not shown)

The cutting drum comprises internal air channels, which are connectable to an air source and a vacuum source (not shown). In selected positions at the peripheral surface of the cutting drum the air channels end in orifices 15. By during use selectively supplying air pressure or vacuum pressure to the orifices, cut articles and rim pieces can be retained or pushed away from the cutting drum 5. The central zone 14 of the cutting drum 5 is involved in this handling of the cut article. With reference to FIG. 2, the cutting unit comprises steering rolls 22 for during use guiding the rim pieces away from the cutting unit.

The cutting unit further comprises a carrier 16. The carrier 16 comprises a plate 17, which is arranged sliding on the four corner columns 2 by bearings 18. Four contact rollers 19 are supported for rotation in the plate 17. The contact rollers 19 are arranged in symmetrical pairs, wherein in each pair of contact rollers 19 is located on either side of the vertical plane C comprising the axis of rotation 8, 9 of the cutting and anvil drums 5, 6. The axes of rotation 20 (FIG. 5) of the contact rollers 19 that are located on the same side of the plane C are located on a common geometrical axis. The axis of rotation 8, 9, 20 of all contact rollers 19, the cutting drum 5 and the anvil drum 6 are parallel. All four contact rollers have the same dimensions, such as the same diameter and the same longitudinal length. The outer peripheral surfaces of the contact rollers 19 are tangent to an imaginary cylinder corresponding to the anvil drum 6.

Figure 4:
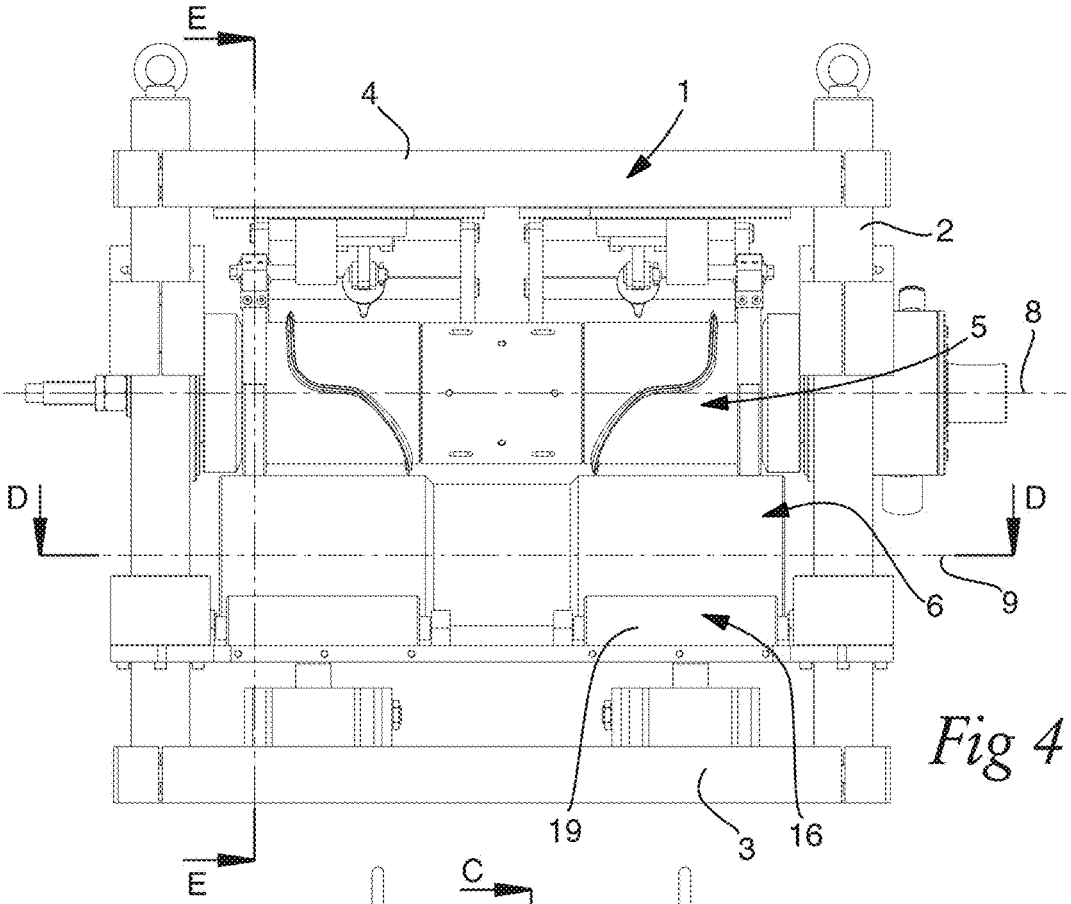
FIG. 4 is a front view of a cutting unit according to the first embodiment of the invention.
Figure 5:
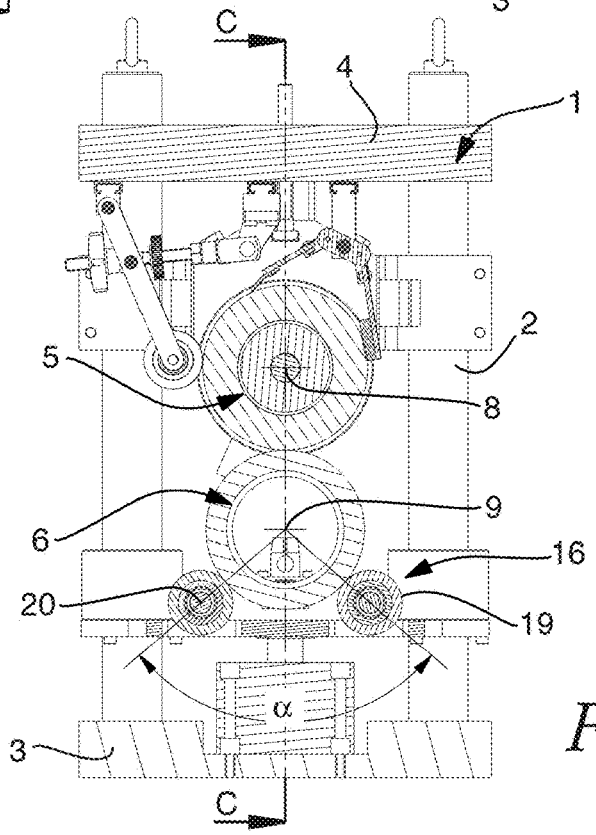
FIG. 5 is a cross section along a transverse, vertical plane through the first embodiment of the invention.

The anvil drum 6 is shaftless, or in other words, has no arbour connecting it to the frame 1. The anvil drum 5 is placed resting on the contact rollers 19 in the carrier 16. The contact rollers 19 are located below a central horizontal plane D, which comprises the centre axis of rotation 9 of the anvil drum 6, for providing vertical support, c.f. FIG. 4. With reference to FIG. 5, a central angle $\alpha$ with the centre axis 9 of the anvil drum 6 as vertex and with the sides passing through the centre axis 20 of one contact roller 19 in a pair of contact rollers 19 respectively is 50° Thereby, the contact rollers 19 provide transversal support to the anvil drum 5.

In other embodiments of the present invention the angle $\alpha$ can be 45-120°. Within this range, the contact rollers 19 are advantageously able to provide both vertical and transversal support to the anvil drum 6.

At each axial end, the lower drum 6 has anvil zones 21 for cooperation with the cutting zones 10 of the cutting drum 5. The anvil zones 21 have a larger diameter than a central zone between them. The anvil zones 21 of the anvil drum 6 have about the same axial length as the cutting zones 10 together with the bearer ring 11 of the cutting drum 5 and are arranged for, in use, being in rolling engagement. The contact rollers 19 have about the same axial length as the anvil zones 21. Consequently, during use, the pressure transmitted by the contact rollers 19 is vertically aligned with the bearer rings 11 and distributed over the cutting zones 21. A transversal, vertical plane E passes through a contact roller 19, an anvil zone 21 and a bearer ring 11, c.f. FIG. 4.

Figure 6:
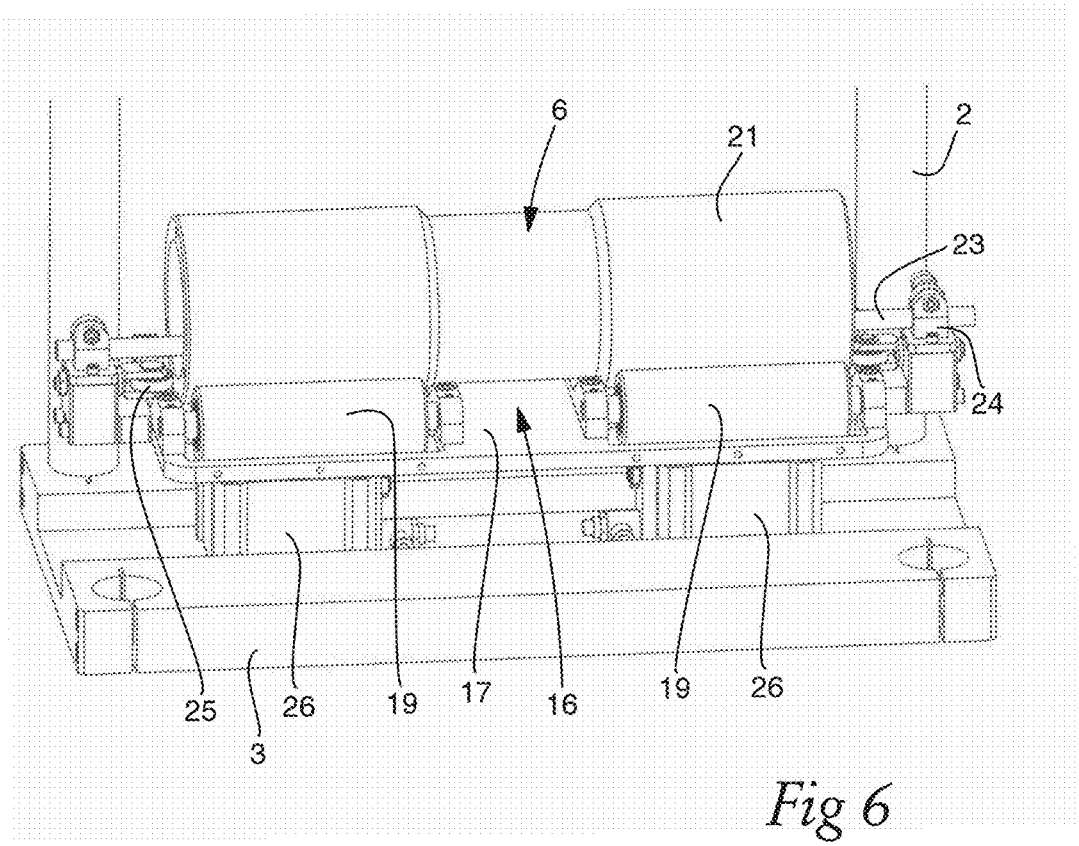
FIG. 6 is an enlarged view of the lower drum and the support arrangement thereof according to the first embodiment of the invention.

With reference to FIG. 6, the lower drum 6 is hollow and has the shape of a tube. A safety device in the form of a bar 23 extends through the hollow anvil drum 6. The bar is releasable lockable in a clamp 24 at each axial end. When in use, and in the position with the anvil drum 6 resting on the contact rollers 19, the bar 23 extends through the hollow drum 6 without contacting the interior walls thereof. The clamp 24 is attached to the carrier 16, so that the position of the bar 23 relative the anvil drum 6 is unaffected when the anvil drum 6 is moved by the carrier 16.

For supporting the anvil drum 6 in the longitudinal axial direction, axial bearings in the form of a wheel 25 are mounted on the frame and in line with the axial end of the anvil drum 6, c.f. FIG. 6.

Between two columns 2 at the axial end of the anvil drum 5, an open space is left. This space forms an opening, which is large enough to allow axial removal of the anvil drum 6 there through.

Finally, the cutting unit comprises two pneumatic cylinders 26, which are connected to the carrier for lifting and pressing the carrier with anvil drum towards and against the cutting drum 5.

During use, when a web material is fed between the cutting drum 5 and the anvil drum 6 for cutting article therefore by the cutting unit according to the first embodiment of the invention, the anvil drum 6 is pressed against the cutting drum by a selected force corresponding to a desired cutting pressure. This is achieved by the air cylinders 26 pressing the carrier 16 with the anvil drum 6 against the cutting drum. Due to the carrier being slidingly arranged on the four columns, the carrier is linearly guided by the columns 2. Thereby, the axis of rotation 9 of the anvil drum 6 is held in parallel with the axis of rotation of the cutting drum, so that good cutting quality is achieved.

The pressure transmitted by the contact rollers 19 extends over the area where the cutting is performed, i.e. along the axial position of the cutting zones 19 and anvil zones 21. In addition, the contact rollers 19 apply pressure at the area of the bearer rings 11. No bending is induced by the pressure from the carrier with the carrier rolls, because the pressure is applied to the lower drum at the same area as the counter pressure is applied by the cutting drum bearer rings 11 being in rolling contact with the anvil drum. Thus, the cutting pressure and/or depth will advantageously be more equal along the axial length of the drums. Consequently, the cutting pressure and depth will be more equal along the axial, longitudinal direction.

Figure 8:
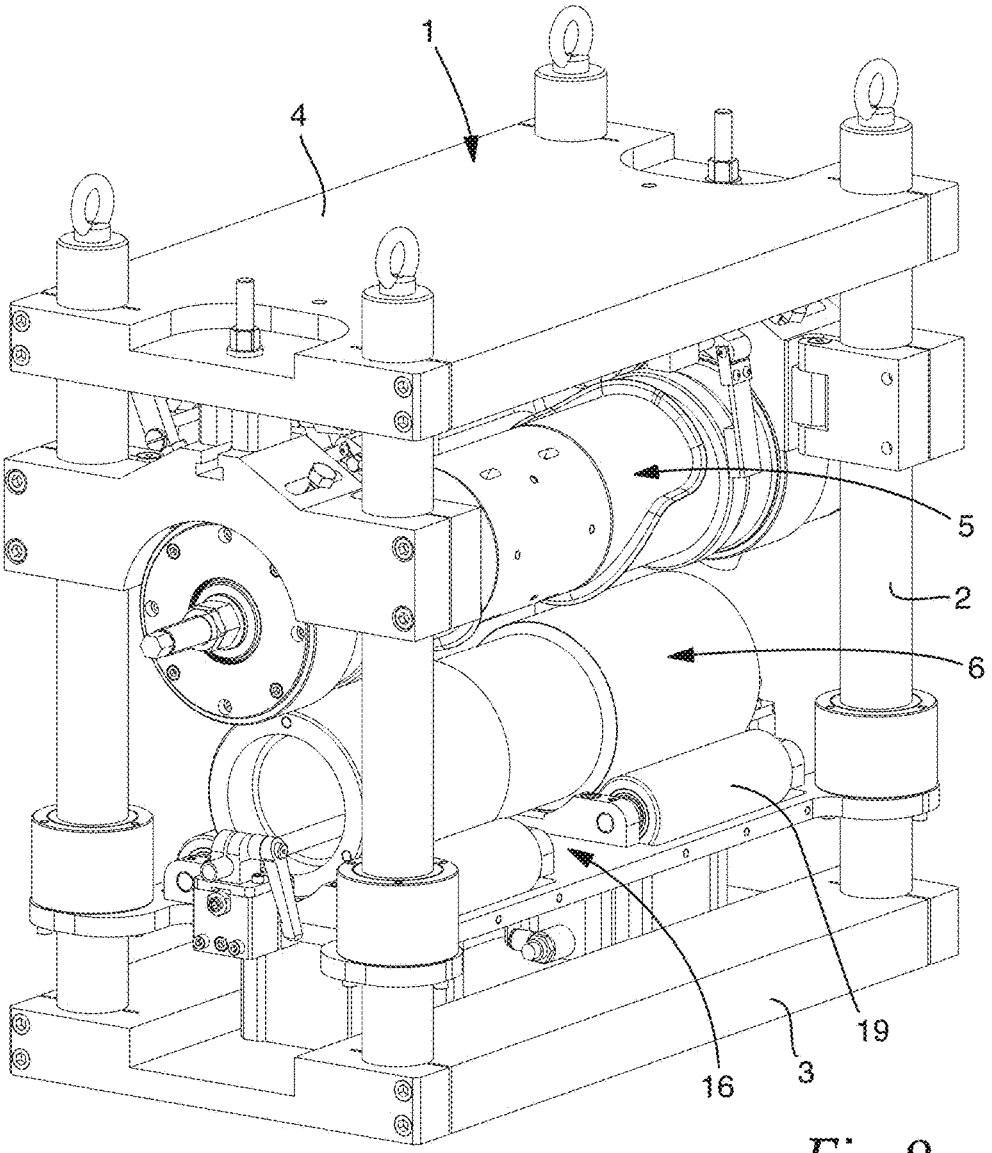
Figure 10:
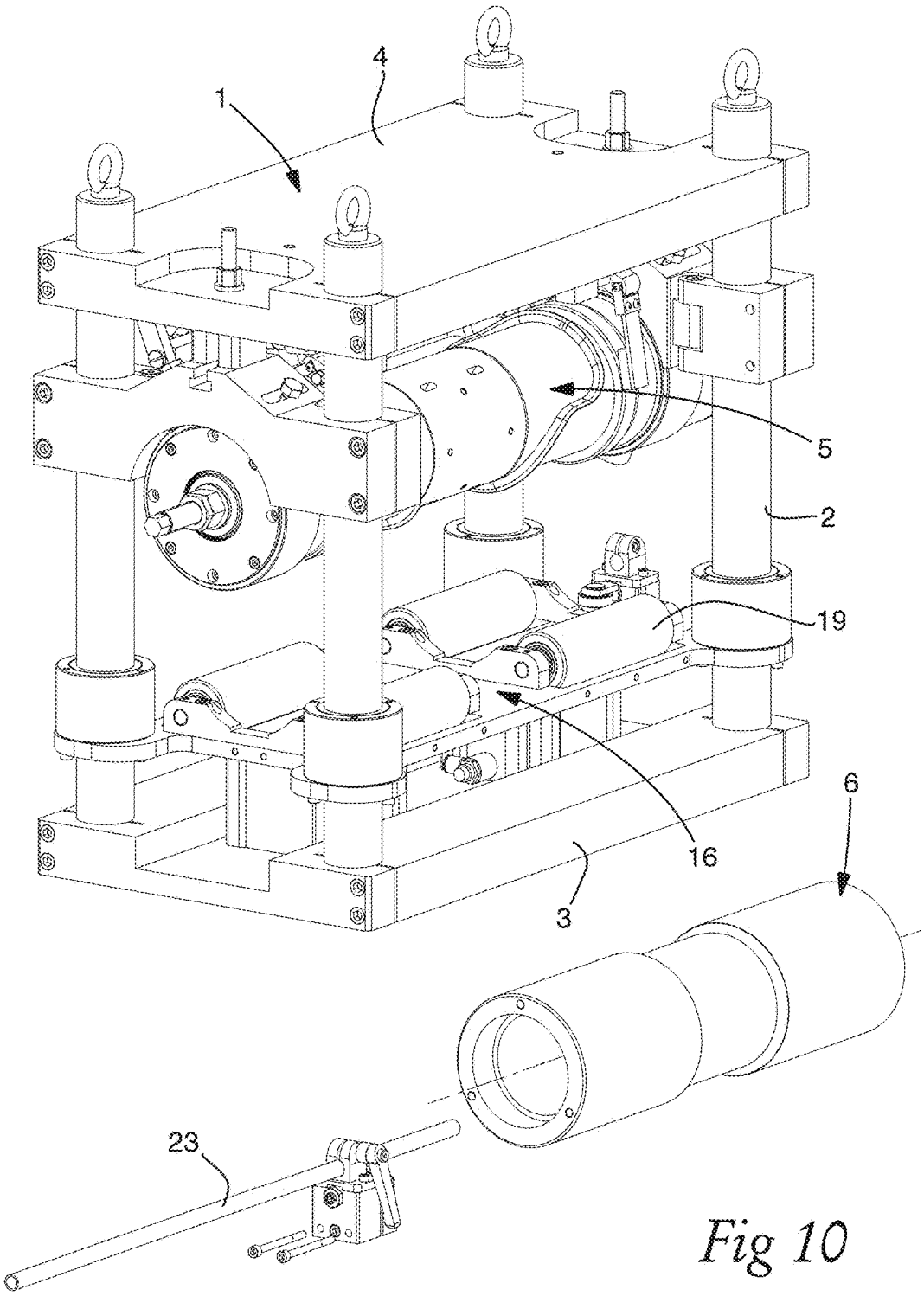

When the cutting unit has been in use for a certain time, it may be necessary to regrind the anvil drum 6. With reference to FIGS. 8-10, an operator can remove the anvil drum 6 by operating the pneumatic cylinders 26 to lower the anvil 6 into a lower position where the anvil drum clears off the cutting drum 5. Then, the clamps 24 are opened so that the bar 23 can be removed. At one axial end, the clamp 24 and the axial bearing wheel 25 are removed. Thereafter, the operator can lift the anvil drum 6 from the contact rollers 19, and pass the anvil drum 6 through the opening provided by the space between the columns 2 at the axial end.

Figure 7:
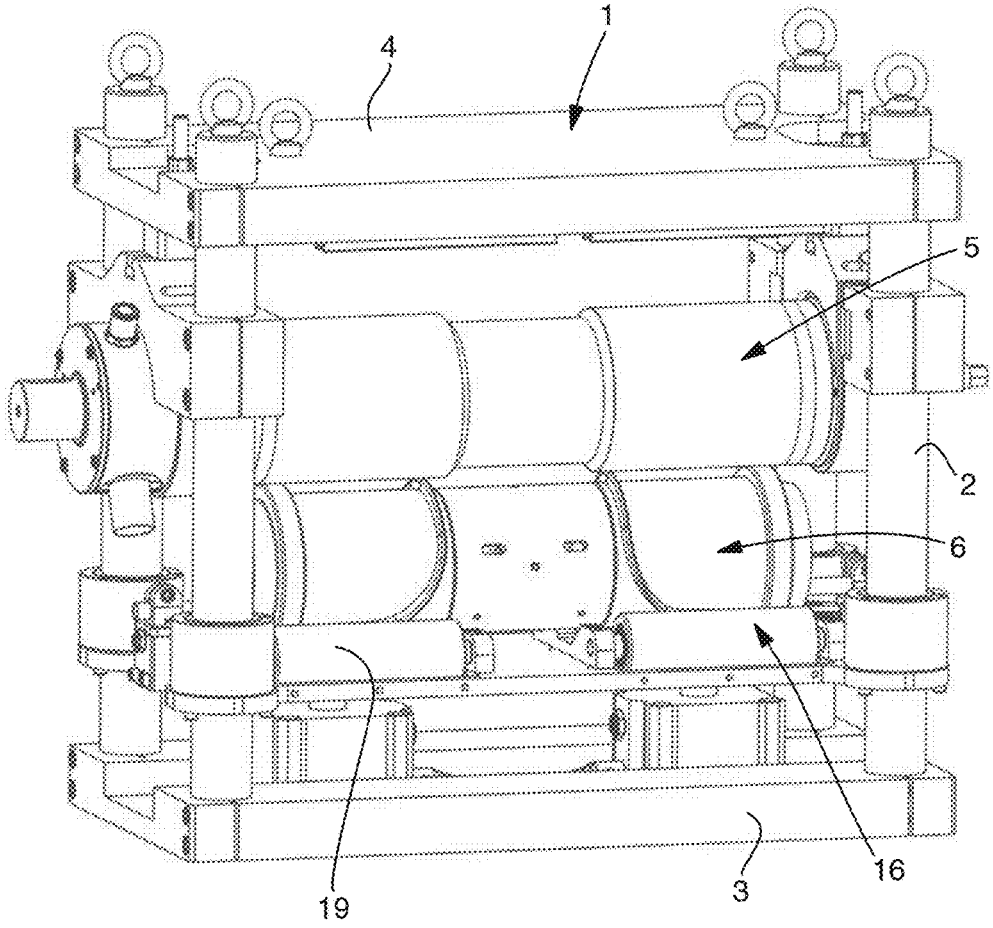
FIG. 7 is a front perspective view of a cutting unit according to a second embodiment of the invention.

During regrinding of the lower drum, the operator has to ensure good cylindrical form, which is directly realized by rotating the lower drum with the outer peripheral surface thereof being in contact with the grindstone. Thanks to the anvil drum 6 being shaft less and being supported on carrier rolls 19 in a carrier 16 instead of having an arbour that is supported by bearing blocks in the frame, the operator need not observe good concentricity with respect to the centre axis, nor observing the position of the centre axis with respect to the arbour or the bearing blocks. Thus, removal of the anvil drum 6 and regrinding thereof is a considerably less complex and time consuming operation In FIG. 7, an alternative embodiment of the present invention is shown, which differ from the first embodiment described above mainly in that the upper drum is the anvil drum 6 and the lower drum is the cutting drum 5.

The invention claimed is:

1. A cutting unit comprising:

a stationary frame;

a upper cutting drum having at least one cutting knife disposed on an outer cylindrical surface of the upper cutting drum and a centre axis of rotation, wherein the at least one cutting knife is arranged on the outer cylindrical surface of the cutting drum in a cutting zone having an axial extension on the cutting drum;

a hollow lower anvil drum having an outer cylindrical surface and a centre axis of rotation, wherein the cutting drum and the anvil drum are arranged one over the other for receiving cutting web material fed between them, the centre axis of rotation of the cutting drum being parallel with the centre axis of rotation of the anvil drum, the cutting drum being centered on an arbour rotatably supported in the stationary frame, the arbour and the cutting drum being rotatable around the centre axis of rotation of the cutting drum, and wherein the anvil drum is rotatable around the centre axis of rotation of the lower anvil drum and movable towards and away from the cutting drum;

a carrier movable towards and away from the cutting drum, wherein the carrier includes a first pair of contact rollers comprising a first left contact roller and a first right contact roller located at a near end of the carrier and a second pair of contact rollers comprising a second left contact roller and a second right contact roller located at a far end of the carrier, each contact roller of the first and second pairs of contact rollers having an outer cylindrical surface and being rotatable around a respective centre axis, each centre axis of each contact roller of the first and second pairs of contact rollers extending parallel with the centre axes of rotation of the cutting drum and the anvil drum, the anvil drum being arbourless and shaftless such that a near end and a far end of the anvil drum are not supported by the frame, the outer cylindrical surface of the anvil drum freely resting only on the outer cylindrical surfaces of the first and second pairs of contact rollers, wherein the first left contact roller and the second left contact roller are situated on a left side of a central vertical plane of the anvil drum and the first right contact roller and the second right contact roller are situated on a right side of the central vertical plane of the anvil drum for providing vertical and transversal support of the anvil drum by the pairs of contact rollers only, such that the anvil drum is supported for rotation by the carrier only, wherein, in a transverse plane relative to the centre axis of rotation of the anvil drum at a location passing through one of the pairs of contact rollers, a central angle is formed with the centre axis of rotation of the anvil drum being a vertex and sides passing through the centre axes of the contact rollers of the one of the pairs of contact rollers and a distance between the centre axes of the two contact rollers of the one of the pairs of contact rollers exceeds both of an inside diameter and an outside diameter of the hollow lower anvil drum;

a safety device comprising a bar which extends through an entire length of the hollow lower anvil drum without contacting an interior wall of the hollow lower anvil drum, wherein the bar extends past each of the near and far ends of the hollow lower anvil drum and a first end of the bar is secured by a first clamp and a second end of the bar is secured by a second clamp, wherein the first and second clamps are attached onto the carrier; and a pressing device connected to the carrier and arranged to move and press the carrier and the anvil drum carried by the carrier towards and against the cutting drum for providing cutting pressure between the cutting drum and the anvil drum.

2. The cutting unit according to claim 1, wherein the contact rollers in the first pair of contact rollers are symmetrical relative to the central vertical plane of the anvil drum, and wherein the contact rollers in the second pair of contact rollers are symmetrical relative to the central vertical plane of the anvil drum.

3. The cutting unit according to claim 2, wherein the cutting zone includes a first cutting sub-zone and a second cutting sub-zone, and wherein each contact roller of the first and second pairs of contact rollers is associated with one of the first cutting sub-zone and the second cutting sub-zone and has an axial extension from at least a transverse plane through a first axial end of the associated first or second cutting sub-zone to a second axial end of the associated first or second cutting sub-zone.

4. The cutting unit according to claim 3, wherein the cutting drum includes a bearer ring disposed at each of first and second axial ends of the cutting drum, each bearer ring being in rolling contact with the anvil drum during cutting, and wherein each bearer ring has a transverse plane in common with a transverse plane of one of the first and second pairs of contact rollers.

5. The cutting unit according to claim 3, wherein the first cutting sub-zone and the second cutting sub-zone are axially separated relative to the centre axis of rotation of the upper cutting drum, wherein, the first cutting sub-zone is located at a first axial end of the cutting drum and the second cutting sub-zone located at a second axial end of the cutting drum, and wherein the axial extension of each contact roller of the first and second pairs of contact rollers has a surface positioned for rolling engagement with a bearer ring disposed at one of the first and second axial ends of the cutting drum.

6. The cutting unit according to claim 1, further comprising axial bearings for providing axial support for the anvil drum.

7. The cutting unit according to claim 1, wherein the safety device is arranged to confine the hollow lower anvil drum to a resting position on the first and second pairs of contact rollers.

8. The cutting unit according to claim 1, wherein the stationary frame has an opening facing an axial end of the anvil drum in a lower position of the stationary frame and having a dimension larger than the largest cross section of the anvil drum for allowing axial removal of the anvil drum.

9. The cutting unit according to claim 1, further comprising a linear guide for guiding the carrier during pressing of the anvil drum towards and against the cutting drum.

10. The cutting unit according to claim 9, wherein the stationary frame includes four corner columns, wherein the linear guide includes at least one of the four corner columns and wherein the carrier is slidably arranged on the at least one corner column of the linear guide.

11. The cutting unit according to claim 1, wherein the cutting drum has a pair of cutting sub-zones and the anvil drum includes a pair of anvil zones that cooperate with the cutting sub-zones, each of the contact rollers of the first and second pairs of contact rollers having an axial length less than an axial length of a respective anvil zone.

12. A cutting unit comprising:

a stationary frame;

an upper cutting drum having at least one cutting knife disposed on an outer cylindrical surface of the upper cutting drum and a centre axis of rotation, wherein the at least one cutting knife is arranged on the outer cylindrical surface of the cutting drum in a cutting zone having an axial extension on the cutting drum;

a hollow lower anvil drum having an outer cylindrical surface and a centre axis of rotation, wherein the cutting drum and the anvil drum are arranged one over the other for receiving cutting web material fed between them, the centre axis of rotation of the cutting drum being parallel with the centre axis of rotation of the anvil drum, the cutting drum being centered on an arbour rotatably supported in the stationary frame, the arbour and the cutting drum being rotatable around the centre axis of rotation of the cutting drum, and wherein the anvil drum is rotatable around the centre axis of rotation of the lower anvil drum and movable towards and away from the cutting drum;

a carrier movable towards and away from the cutting drum, wherein the carrier includes a first pair of contact rollers comprising a first left contact roller and a first right contact roller located at a near end of the carrier, and the carrier includes a second pair of contact rollers comprising a second left contact roller and a second right contact roller located at a far end of the carrier, each contact roller of the first and second pairs of contact rollers having an outer cylindrical surface and being rotatable around a respective centre axis, each centre axis of each contact roller of the first and second pairs of contact rollers extending parallel with the centre axes of rotation of the cutting drum and the anvil drum, the anvil drum being arbourless and shaftless such that a near end and a far end of the anvil drum are not supported by the frame, the outer cylindrical surface of the anvil drum freely resting only on the outer cylindrical surfaces of the first and second pairs of contact rollers, wherein the first left contact roller and the second left contact roller are situated on a left side of a central vertical plane of the anvil drum and the first right contact roller and the second right contact roller are situated entirely on a right side of the central vertical plane of the anvil drum for providing vertical and transversal support of the anvil drum by the pairs of contact rollers only, such that the anvil drum is rotatable about the centre axis of rotation of the anvil drum, said center axis of rotation of the anvil drum being parallel to the centre axis of each contact roller of the first and second pairs of contact rollers such that, in a transverse vertical plane, the centre axis of each contact roller of the first and second pairs of contact rollers is oriented relative to the centre axis of the anvil drum in a v-shape formation, with the centre axis of the anvil drum located at a vertex of the v-shape and the centre axes of the contact rollers of the first and second pairs of contact rollers located at tips of the v-shape distal from the vertex, where a vertex angle of the v-shape is at least 45' and at most 120';

a safety device comprising a bar which extends through an entire length of the hollow lower anvil drum without contacting an interior wall of the hollow lower anvil drum, wherein the bar extends past each of the near and far ends of the hollow lower anvil drum and a first end of the bar is secured by a first clamp and a second end of the bar is secured by a second clamp, wherein the first and second clamps are attached onto the carrier; and a pressing device connected to the carrier and arranged to move and press the carrier and the anvil drum carried by the carrier towards and against the cutting drum for providing cutting pressure between the cutting drum and the anvil drum, wherein the anvil drum is hollow and contains the bar of the safety device to prevent the anvil drum from being ejected if contact is lost between the first and second pairs of contact rollers and the anvil drum.

13. The cutting unit according to claim 12, wherein the contact rollers in the first pair of contact rollers are symmetrical relative to the central vertical plane of the anvil drum, and wherein the contact rollers in the second pair of contact rollers are symmetrical relative to the central vertical plane of the anvil drum.

14. The cutting unit according to claim 13, wherein the cutting zone includes a first cutting sub-zone and a second cutting sub-zone, and wherein each contact roller of the first and second pairs of contact rollers is associated with one of the first cutting sub-zone and the second cutting sub-zone and has an axial extension from at least a transverse plane through a first axial end of the associated first or second cutting sub-zone to a second axial end of the associated first or second cutting sub-zone.

15. The cutting unit according to claim 14, wherein the cutting drum includes a bearer ring disposed at each of first and second axial ends of the cutting drum, each bearer ring being in rolling contact with the anvil drum during cutting, and wherein each bearer ring has a transverse plane in common with a transverse plane of one of the first and second pairs of contact rollers.

16. The cutting unit according to claim 15, wherein the first cutting sub-zone and the second cutting sub-zone are axially separated relative to the centre axis of rotation of the upper cutting drum, wherein, the first cutting sub-zone located at the first axial end of the cutting drum and the second cutting sub-zone located at the second axial end of the cutting drum, and wherein the axial extension of each contact roller of the first and second pairs of contact rollers has a surface positioned for rolling engagement with one of the bearer rings.

17. The cutting unit according to claim 12, further comprising axial bearings for providing axial support for the anvil drum.

18. A cutting unit comprising:

a stationary frame;

an upper cutting drum having at least one cutting knife disposed on an outer cylindrical surface of the upper cutting drum and a centre axis of rotation, wherein the at least one cutting knife is arranged on the outer cylindrical surface of the cutting drum in a cutting zone having an axial extension on the cutting drum;

a hollow lower anvil drum having an outer cylindrical surface and a centre axis of rotation, wherein the cutting drum and the anvil drum are arranged one over the other for receiving cutting web material fed between them, the centre axis of rotation of the cutting drum being parallel with the centre axis of rotation of the anvil drum, the cutting drum being centered on an arbour rotatably supported in the stationary frame, the arbour and the cutting drum being rotatable around the centre axis of rotation of the cutting drum, and wherein the anvil drum is rotatable around the centre axis of rotation of the lower anvil drum and movable towards and away from the cutting drum;

a carrier movable towards and away from the cutting drum, wherein the carrier includes a first pair of contact rollers comprising a first left contact roller and a first right contact roller located at a near end of the carrier, and the carrier includes a second pair of contact rollers comprising a second left contact roller and a second right contact roller located at a far end of the carrier, each contact roller of the first and second pairs of contact rollers having an outer cylindrical surface and being rotatable around a respective centre axis, each respective centre axis of the first and second pairs of contact rollers extending parallel with the centre axes of rotation of the cutting drum and the anvil drum, the anvil drum being arbourless and shaftless such that a near end and a far end of the anvil drum are not supported by the frame, the outer cylindrical surface of the anvil drum freely resting only on the outer cylindrical surfaces of the first and second pairs of contact rollers, wherein the first left contact roller and the second left contact roller are situated on a left side of a central vertical plane of the anvil drum for providing vertical and transversal support of the anvil drum by the pairs of contact rollers only, such that the anvil drum is rotatable about the centre axis of rotation of the anvil drum, said centre axis of rotation of the anvil drum being parallel to the centre axis of each contact roller of the first and second pairs of contact rollers such that, in a transverse vertical plane, the centre axis of each contact roller of the first and second pairs of contact rollers is oriented relative to the centre axis of the anvil drum in a v-shape formation, with the centre axis of the anvil drum located at a vertex of the v-shape and the centre axes of the contact rollers of the first and second pairs of contact rollers located at tips of the v-shape distal from the vertex, where a vertex angle of the v-shape is at least 45° and at most 120°;

a safety device comprising a bar which extends through an entire length of the hollow lower anvil drum without contacting an interior wall of the hollow lower anvil drum, wherein the bar extends past each of the near and far ends of the hollow lower anvil drum and a first end of the bar is secured by a first clamp and a second end of the bar is secured by a second clamp, wherein the first and second clamps are attached onto the carrier; and a pressing device connected to the carrier and arranged to move and press the carrier and the anvil drum carried by the carrier towards and against the cutting drum for providing cutting pressure between the cutting drum and the anvil drum.

* * * * *